US008833575B2

(12) United States Patent
Fave-Lesage

(10) Patent No.: US 8,833,575 B2
(45) Date of Patent: Sep. 16, 2014

(54) ARTIFICIAL SUCKLING SYSTEM

(76) Inventor: Francois Fave-Lesage, Coussey (FR)

( * ) Notice: Subject to any disclaimer, the term of this patent is extended or adjusted under 35 U.S.C. 154(b) by 0 days.

(21) Appl. No.: 13/393,887

(22) PCT Filed: Sep. 3, 2010

(86) PCT No.: PCT/EP2010/062994

§ 371 (c)(1),
(2), (4) Date: Mar. 2, 2012

(87) PCT Pub. No.: WO2011/026956

PCT Pub. Date: Mar. 10, 2011

(65) Prior Publication Data

US 2012/0160797 A1 Jun. 28, 2012

(30) Foreign Application Priority Data

Sep. 3, 2009 (FR) ..... 09 56018

(51) Int. Cl.
*A61J 11/00* (2006.01)

(52) U.S. Cl.
USPC ..... 215/11.4; 215/11.6; 215/11.5; 215/11.1; 215/44; 215/43; 222/490; 606/236; 606/234

(58) Field of Classification Search
CPC ..... A61J 11/00; A61J 11/002; A61J 11/0035; A61J 11/005; A61J 11/045; A47G 21/185; A01K 9/005
USPC ..... 215/11.1–11.6; D24/194, 196–197; 606/234, 236; 222/490
See application file for complete search history.

(56) References Cited

U.S. PATENT DOCUMENTS 357,439 A * 2/1887 Wheelook ..... 215/11.5
2,558,069 A * 6/1951 Alben ..... 105/49
3,070,249 A * 12/1962 Schrwald ..... 215/11.1

(Continued)

FOREIGN PATENT DOCUMENTS

AU 2005202455 A1 * 6/2005
EP 1 275 366 1/2003

(Continued)

OTHER PUBLICATIONS

Adair et al., "Evaluation of the Effects of Orthodontic Pacifiers on the Primary Dentitions of Twenty-four—to Fifty-nine-month-old Children: Preliminary Study Abstract," *The American Academy of Pediatric Dentistry*, http://www.aapd.org/searcharticles/article.asp?article_id=1052, 1992.

(Continued)

*Primary Examiner* — Mickey Yu
*Assistant Examiner* — Brijesh V. Patel
(74) *Attorney, Agent, or Firm* — Fulbright & Jaworski LLP

(57) ABSTRACT

Teats adapted to be placed in an infant's mouth, comprising a nipple comprising at least one perforation adapted for the flow of a liquid, an areola, and an isthmus joining the nipple to the areola, wherein the nipple comprises asymmetrical palatine and lingual parts and the isthmus joins the nipple and the areola in a manner adapted for the correct positioning of lower and upper jawbones during use, and further wherein the teats are adapted to allow controlled expulsion and flow during use. Also disclosed are feeding bottles comprising such teats and feeding systems comprising such feeding bottles.

16 Claims, 6 Drawing Sheets

(56) References Cited

U.S. PATENT DOCUMENTS

| | | | | | |
|---|---|---|---|---|---|
| 3,082,770 | A | | 3/1963 | Straub | 215/11.1 |
| 3,777,753 | A | * | 12/1973 | Kesselring et al. | 215/11.1 |
| 4,505,398 | A | * | 3/1985 | Kesselring | 215/11.5 |
| D294,735 | S | * | 3/1988 | Morano et al. | D24/196 |
| 4,834,099 | A | * | 5/1989 | Schrooten | 215/11.1 |
| 4,993,568 | A | * | 2/1991 | Morifuji et al. | 215/11.1 |
| 5,190,174 | A | * | 3/1993 | Klag | 215/11.1 |
| 5,427,259 | A | * | 6/1995 | Krastanov | 215/11.1 |
| 5,582,335 | A | * | 12/1996 | Beard et al. | 215/11.6 |
| 5,653,732 | A | * | 8/1997 | Sheehy | 606/236 |
| 6,645,228 | B2 | | 11/2003 | Renz | 606/236 |
| 6,745,912 | B2 | | 6/2004 | Uehara et al. | 215/11.1 |
| 6,957,744 | B2 | * | 10/2005 | Holley, Jr. | 215/11.1 |
| 7,326,234 | B2 | * | 2/2008 | Lieberman et al. | 606/236 |
| 8,172,874 | B2 | * | 5/2012 | Randolph et al. | 606/236 |
| 2002/0063103 | A1 | * | 5/2002 | Kiernan | 215/11.4 |
| 2003/0089676 | A1 | * | 5/2003 | Uehara et al. | 215/11.1 |
| 2003/0163162 | A1 | * | 8/2003 | Uehara et al. | 606/234 |
| 2004/0059382 | A1 | * | 3/2004 | Bergersen | 606/234 |
| 2004/0124168 | A1 | * | 7/2004 | Silver | 215/11.1 |
| 2004/0220618 | A1 | * | 11/2004 | Rohrig | 606/234 |
| 2006/0011572 | A1 | * | 1/2006 | Pegg | 215/11.1 |
| 2006/0036285 | A1 | * | 2/2006 | Davis | 606/234 |
| 2006/0175278 | A1 | * | 8/2006 | Schlumpf | 215/11.1 |
| 2007/0131637 | A1 | * | 6/2007 | Tamura et al. | 215/11.1 |
| 2007/0238063 | A1 | * | 10/2007 | Tesini et al. | 433/7 |
| 2009/0255895 | A1 | * | 10/2009 | Kiehne | 215/11.5 |
| 2010/0072161 | A1 | * | 3/2010 | Viggiano | 215/11.3 |
| 2010/0268276 | A1 | * | 10/2010 | Du Chesne et al. | 606/236 |
| 2011/0100944 | A1 | * | 5/2011 | Van Der Kooi et al. | 215/11.1 |

FOREIGN PATENT DOCUMENTS

| | | |
|---|---|---|
| WO | WO 91/03225 | 3/1991 |
| WO | WO 2004/010921 | 2/2004 |
| WO | WO 2004/026219 | 4/2004 |
| WO | WO 2009081145 A2 * | 7/2009 |

OTHER PUBLICATIONS

Ball and Wright, "Health Care Costs of Formula-feeding in the First Year of Life," *Pediatrics*, 103(S1):870-876, 1999.

Davis & Bell, "Infant feeding practices and occlusal outcomes: a longitudinal study," *J Can Dent Assoc*, 57(7):593-594, 1991.

Gomes et al., "Surface electromyography of facial muscles during natural and artificial feeding of infants", Journal de Peditria, 82(2):103-109, 2006.

Horta et al., Evidence of long-term effects of breastfeeding: Systematic Reviews and Meta-Analyses, *World Health Organization*, pp. 1-57, 2007.

International Search Report, issued in International Patent Application No. PCT/EP2010/062994, mailed on Oct. 10, 2010.

Labbok & Hendershot, "Does breast-feeding protect against malocclusion? An analysis of the 1981 Child Health Supplement to the National Health Interview Survey," Am J Prev Med., 3(4):227-232, 1987.

Palmer, "Section A: The importance of breastfeeding as it relates to total health," Illfrance.org, 2002.

Palmer, "Section B: The importance of breastfeeding as it relates to total health," Illfrance.org, 2002.

Palmer, "Section C: The importance of breastfeeding as it relates to total health," Illfrance.org, 2002.

Radzi et al., "Relationship Between Breast-Feeding & Bottle-Feeding to Craniofacial & Dental Development", Annual Dent. Univ. Malaya, 12:9-17, 2005.

Viggiano et al., "Breast Feeding, bottle feeding, and non-nutritive sucking; effects on occlusion in deciduous dentition", *Arch. Dis. Child*, 89:1121-1123, 2004.

Woolridge, "The 'anatomy' of infant sucking", Midwifery, 2(4): 164-71, 1986.

* cited by examiner

ARTIFICIAL SUCKLING SYSTEM

This application is a national phase application under 35 U.S.C. §371 of International Application No. PCT/EP2010/062994 filed 3 Sep. 2010, which claims priority to French Application No. 0956018 filed 3 Sep. 2009. The entire text of each of the above-referenced disclosures is specifically incorporated herein by reference without disclaimer.

FIELD OF THE INVENTION

The present invention relates to the field of child care, and more specifically to the field of feeding children aged from 0 to 6 years. More specifically, the subject matter of the present invention is an artificial feeding system. The present invention thus relates to a feeding bottle, comprising a teat and a reservoir on which the teat can be adjusted by means of a holding ring, and a reservoir holder comprising a strap suitable for supporting the reservoir, the combination of these two items forming the artificial feeding system according to the invention.

The teat according to the invention is specifically designed to be suitable for the anatomy of infants, and enables the natural muscle action associated with feeding.

The Applicant carried out searches on the causes of maxillofacial development disorders, which are increasing in frequency in modern society. Studies have proven a direct relationship between these disorders and two factors: infant feeding and modern nutrition (Nutrition and physical degeneration. 6th Ed, Keats Publishing, 1997).

Breastfeeding is a natural and essential stimulus, both in psychological and muscular terms, of infants during the first year of their lives. For example, during the first year of their lives, infants ingest approximately 300 liters of milk and make over 3 million suckling movements, thus over 3 million craniofacial development stimuli, along with non-nutritional suckling stimuli. It is known that breastfeeding promotes normal facial bone growth, and does not give rise to malocclusions ("Evidence of long-term effects of breastfeeding", WHO 2007; "The importance of breastfeeding as it relates to total health", Dr Brian Palmer 2002; dossier de l'allaitement N° 42, lllfrance.org). However, artificial feeding is currently predominant and has become a social reality. It has emerged from U.S. and Australian studies (Labbok & Hendershot 1987, Davis & Bell 1991) that the use of current teats gives rise to a 32.5% rate of malocclusions at 3 years of age and 89% for children of 12 to 17 years of age, demonstrating that the teats currently on the market impede normal growth of newborn infants. In 1999, the increase in health expenditure (outpatient and inpatient care) associated with artificial feeding with unsuitable teats according to the prior art is estimated at 170 million Euro in France (based on the studies by Ball & Wright, 1999). Therefore, proper feeding has become a public health issue.

BACKGROUND OF THE INVENTION

In the prior art, some artificial feeding systems devised to prevent the development of maxillofacial disorders are available. Reference may be made, for example, to WO2004/026219, describing a teat intended to maintain normal dentition and normal jaw development in infants. This teat comprises a bulb, an isthmus of a thickness less than the thickness of prior teats, and a skirt. WO2004/026219 specifies that, given that the isthmus extends from the outer skirt to the bulb, this teat prevents the infant from developing malocclusions (see WO2004/026219 page 4, line 35 and page 5, line 3).

Some systems attempt to reproduce or imitate breastfeeding: for example, U.S. Pat. No. 6,645,228 and U.S. Pat. No. 6,745,912. In U.S. Pat. No. 6,645,228, the upper part of the teat, i.e. the areola and the nipple, can be moved under the baby's sucking action, since the lower part has a thinner region acting as a spring. In U.S. Pat. No. 6,745,912, grooves provided in the lower part of the teat enable pulling of the nipple.

However, in both systems, the movements of the areola and the end do not actually imitate the movement of breastfeeding.

U.S. Pat. No. 3,082,770 describe an asymmetric teat comprising an isthmus and an areola which is concave in the lower part thereof and convex in the upper part thereof, requiring pressure from the infant during feeding. Nevertheless, this specific teat arrangement does not make it possible to reproduce natural breastfeeding action faithfully. Indeed, the movement of the tongue induced by the teat according to U.S. Pat. No. 3,082,770 is a piston movement against the palate, with the tongue in the posterior position, giving rise to deformation of the palate. On the other hand, the natural movement of the tongue during feeding is a peristaltic movement. In addition, the posterior position of the tongue induced by the teat according to U.S. Pat. No. 3,082,770 prevents correct posterior closure of the oral cavity, giving rises to otitis and false passage phenomena.

WO 2004/010921 describes an asymmetric teat, making it possible, by means of the material from which it is formed, and the presence of specific means, particularly air inlets, to reduce the feeding effort, particularly by removing any breathing difficulties for the infant. However, the technical means used by this teat are completely different from those according to the present invention.

Moreover, commercially available teats and soothers, claimed to be "orthodontic" or "physiological", have no medical validation in support of these claims. Studies have demonstrated the lack of a significant difference between so-called physiological teats and soothers and conventional teats ("Evaluation des effets des sucettes orthodontiques sur la dentition lactéale d'enfants âgés de 24 à 59 mois", Adair & Milano & Dushku).

At the present time, none of the teats on the market enables natural suckling muscle function: on these teats, the baby exerts pressure with the tongue on the palate with a piston movement and significant endobuccal depression associated with abnormal cheek muscle action. The disturbance of the natural function has medium-term repercussions on the infant's growth and long-term repercussions on health: on the physical health, firstly (jawbone, facial growth defect, oral breathing, postural joint disorders) and also on mental and psychological health ("Impact de l'allaitement maternel sur le développement cognitif de l'enfant", the effect is dose-dependent: santeallaitementmaternel.com). WHO defines mental health as "a state of complete physical, mental and social well-being, and not merely the absence of disease".

This invention aims at reproducing all the functions fulfilled by breastfeeding, on both a physical and psychological level.

In view of the systems currently on the market, there is a clear need for a teat making it possible to reproduce the muscle action produced by the infant during breastfeeding, particularly of the lips, cheeks, and more generally the facial muscles, tongue and masticatory muscles, observe the infant's oral anatomy and thus prevent the appearance of maxillofacial development disorders and dental arch relationship disorders and improve the subjects' general health.

Especially, the invention intends to reproduce the natural peristaltic movement of the tongue. The natural peristaltic movement of the tongue creates a wave at the centre of the roll formed by the infant's tongue, curved around the nipple when in the suckling position.

In psychological terms, the Applicant intends to meet the infant's basic need for physical contact by reducing the distance between mother and infant which is frequently increased in the case of artificial feeding, making it possible to retain the natural olfactory, auditory, visual and dermal stimulations of feeding.

Some studies have demonstrated that prolonged contact time between mother and infant significantly promotes bonding between mother and infant and the cognitive development of the infant. Observation of the mother and infant during breast or artificial feeding demonstrates that the postural adjustment of some mothers gives rise to awkwardness and discomfort, for both mother and infant. The present invention thus also seeks to optimise mother-infant postural adjustment.

SUMMARY

In this way, the invention relates to a teat intended to be placed in an infant's mouth, characterised in that it comprises at least three jointed parts, which are a nipple comprising, at the end thereof, at least one perforation intended for the flow of a liquid, an areola, an isthmus joining the nipple to the areola, and optionally a skirt, wherein:

- the nipple comprises an upper part or palatine part and a lower part or lingual part which are asymmetric; the palatine part of the nipple comprises means for ensuring the correct positioning of the nipple against the infant's palate; the lingual part of the nipple has an overall convex shape at the centre with two lateral concavities enabling the infant's tongue to roll in a naturally grooved position, in contact with the teat; these technical features thus ensure the natural positioning of the infant's tongue and the natural peristaltic movement,
- the isthmus joins the nipple and the areola, said join being narrowed for the correct positioning of the lower and upper jawbones, the isthmus further comprising means for ensuring the controlled expulsion and flow of milk from the teat under the muscle action of the infant on the teat;
- the areola has a slightly concave shape and has a wide neck so as to provide infant-teat contact from the chin to the neck.

Advantageously, the teat according to the invention comprises means for ensuring the correct positioning of the nipple against the infant's palate, said means being surface conditions involved in the suckling function, i.e. protruding and/or rough elements on the palatine part.

According to a preferred embodiment of the invention, the protruding and/or rough elements on the palatine part and the smooth surface condition of the lingual part promote correct suckling function.

According to a first embodiment, the means for ensuring the correct positioning of the nipple against the infant's palate are protruding elements moulded on the surface of the upper part providing the surface of the upper part with a roughness retaining same against the infant's palate. According to a further embodiment, the palatine part of the nipple has a thickness of 1 to 5 mm and the lingual part of the nipple has a thickness of 0.1 to 2 mm and has a smooth surface to prevent any tongue irritation.

According to a further embodiment, the teat is moulded in one piece. The moulding may be performed by injection moulding or compression moulding.

According to the invention, the nipple is provided, at the end thereof or on the uppermost surface thereof, with at least three perforations, for example 3, 4, 5, 6, 7, 8 or 9 perforations. According to one preferred embodiment of the invention, the nipple is provided with 3 to 7 perforations, preferably 5 perforations. Said perforations are preferentially 0.3 to 0.6 mm in diameter, preferably about 0.4 mm.

Advantageously, the means present in the isthmus (1) provide the flow of milk from the areola to the nipple under the action of the infant's masticatory muscles compressing the valve; (2) facilitate the expulsion of milk from the teat via the abovementioned perforations, under the effect of the peristaltic movement of the tongue, by limiting milk reflux to the areola. These means are a valve, a bevelled opening, a flap, a diaphragm or a biconcave lens, preferably a valve consisting of a 3 to 8 mm, preferably 4 to 6 mm, more preferentially 5 mm, vertical slot. Milk flow is promoted by minimum vertical pressure from the mandible on said means, thus by the minimum muscular propulsion action required for mandibular growth. The action of the masticatory muscles (masseter, pterygoid and temporal muscles) further pulls the larynx into the upper position and thus seals between the oral cavity and the upper airways, thus limiting false passage and otitis phenomena. According to a preferred embodiment of the invention, these means enable a minimum flow of liquid in the absence of pressure via the valve. However, due to the fine size of the perforations and the size and shape of the valve, the teat does not allow any undesirable flow of liquid merely under the effect of gravity. In particular, said means make it possible to limit, or even completely prevent, milk reflux into the reservoir (since the valve is closed as it is not compressed by the mandible at that stage of the feed).

According to a preferred embodiment, the teat has a length, from the end of the nipple to the opposite end of the teat, between 2.5 and 5.5 centimeters, preferably between 3 and 5 centimeters, more preferentially 4 to 4.5 centimeters.

Advantageously, the teat according to the invention is made of thermoplastic elastomer, latex or silicone, preferentially silicone having a Shore hardness of 30 to 45, preferentially of 35 to 40, more preferentially about 35 degrees Shore.

Advantageously, the teat according to the invention has a thickness of about 1 mm, with the exception of the palatine and lingual areas of the nipple as described above, and a similar texture to that of the dermis. Advantageously, the texture of the teat is provided by the surface condition thereof, which is rough in the palatine area and smooth in the lingual area. Advantageously, the surface condition of the teat is the result of work on the surface condition of the mould.

The teat according to the invention may comprise a skirt for attaching a reservoir; in this embodiment, the teat is preferentially for feeding.

According to a further embodiment, the teat according to the invention is not for feeding (soother); in this embodiment, the teat is preferably provided with a shield preventing air intake by the infant, and is preferably attached to gripping means.

The invention also relates to a feeding bottle comprising a teat according to the invention, a reservoir and a ring for holding the teat onto the reservoir, said reservoir having an angulation between 60 and 110°, preferably about 90°. According to a preferred embodiment of the invention, the reservoir has, at the end thereof opposite the teat, an opening that is preferably closed with a silicone cap suitable for being removed during feeding so as to replace the liquid consumed by air. Said cap is preferentially Y-shaped. The capacity of the reservoir is preferably 200 to 250 ml.

The invention also relates to a feeding system comprising a feeding bottle according to the invention comprising a reservoir, and a reservoir holder comprising a strap, wherein said reservoir comprises means for attaching the reservoir holder to the reservoir. The combination of the angulation of the reservoir and the reservoir holder makes it possible to retain the natural mother-infant position; with skin-to-skin contact and preserving sensory stimuli.

DETAILED DESCRIPTION

The present invention will be understood more clearly on reading the detailed description hereinafter, which illustrates the invention non-restrictively and should be read with reference to the figures.

Figure 1:
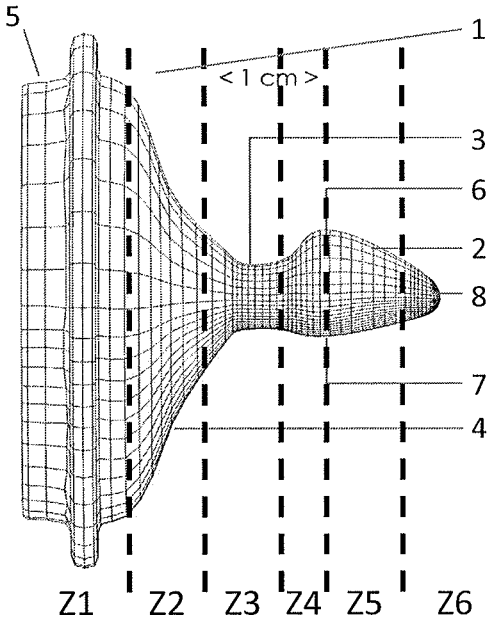
FIG. 1 represents a side profile view of the teat according to the invention.

FIG. 1 represents a side view of the teat 1 comprising four jointed parts, an end nipple 2, an areola 4, an isthmus 3 joining the nipple to the areola, the palatine 6 and lingual 7 parts of the nipple 2, the perforations 8 and optionally an attachment skirt 5. In particular, FIG. 1 shows a profile view of the nipple 2 illustrating the asymmetry of the nipple 2 and particularly the convex shape of the palatine part 6.

Figure 2:
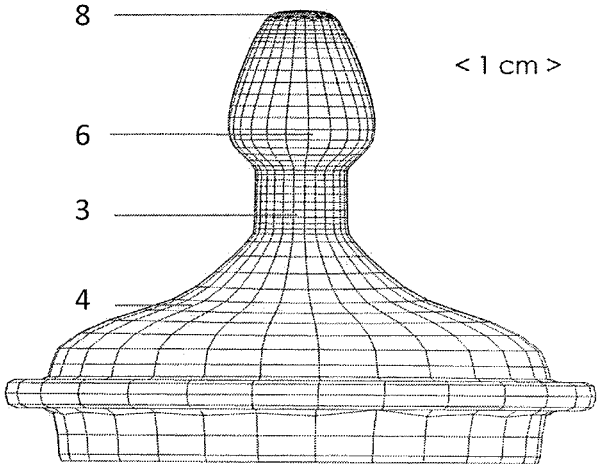
FIG. 2 represents a bottom to top profile view of the teat according to the invention.

FIG. 2 represents a side view of the teat 1 comprising an areola 4, an isthmus 3 joining the nipple 2 to the areola 4, a front view of the palatine part 6, and the perforations 8.

The morphology of the nipple 2 (represented as endobuccal in FIG. 7) is suitable for the infant's anatomy. It has an elliptical or oval shape. The compact size and the elliptical shape of the teat according to the invention compared to conventional teats are intended not to cause jawbone and palate deformations.

Figure 4:
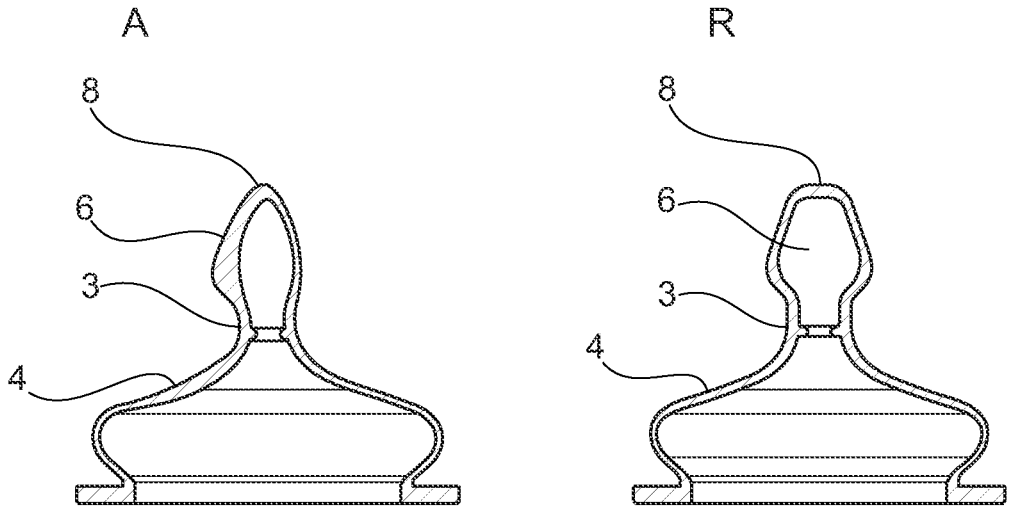
FIG. 4A represents a cross-section of the view in FIG. 1 along a vertical axis.
FIG. 4B represents a cross-section of the view in FIG. 2 along a vertical axis.

The nipple 2 is asymmetric. The upper or palatine part 6 of the nipple 2 is shaped similar to a semi-bubble, which is suitable for the infant's palate and enables the stimulation of the area in which a sucking reflex originates. Advantageously, the semi-bubble has a radius of 4 to 8 mm, preferably about 6 mm. The surface of the semi-bubble bears means for ensuring the correct positioning of the nipple 2 against the infant's palate: these means are rough areas or protruding elements (not shown) moulded with the teat; these rough areas or protruding elements and the thickness of the material (represented in FIG. 4) make it possible to facilitate the stabilisation of the teat by the palatal rugae and thus hold the nipple 2 against the infant's palate. According to one preferred embodiment of the invention, the palatine part 6 of the nipple 2 is 1 to 5 mm thick.

Figure 3:
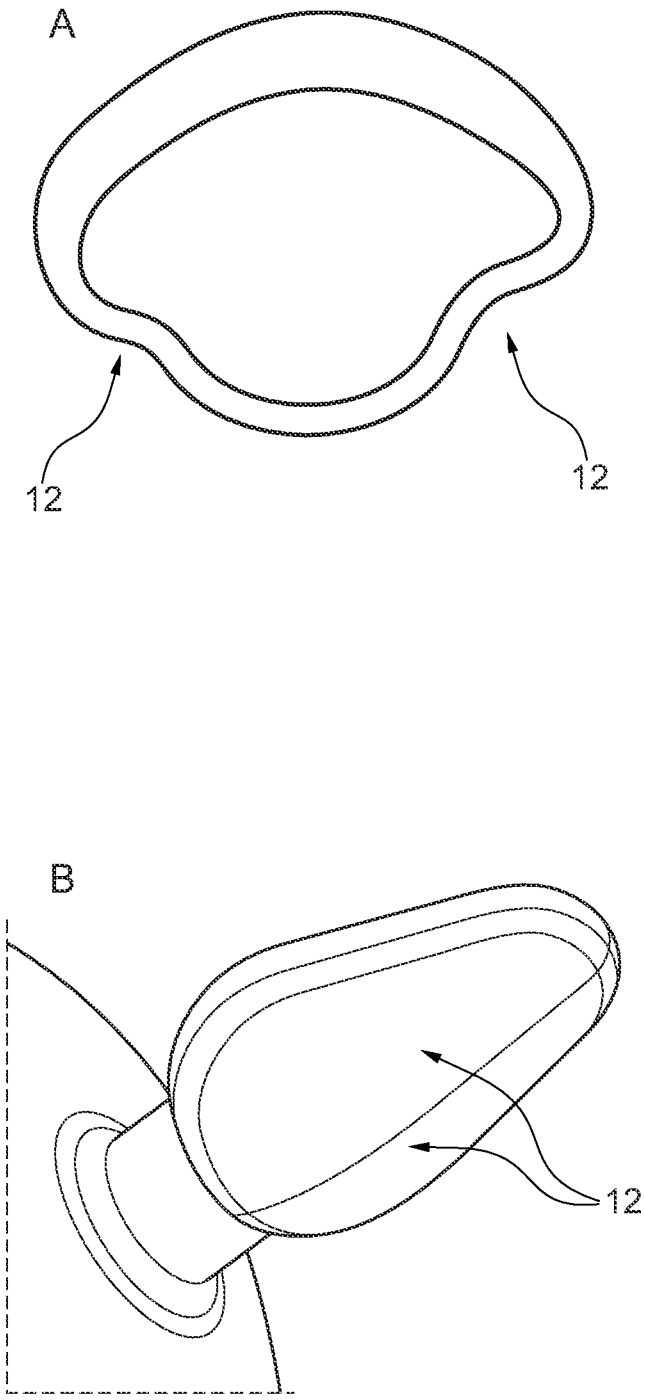
FIG. 3 represents a cross-section view (A) or a perspective view (B) of the nipple of the teat according to the invention from the areola to the nipple, showing the lateral concavities.

The lower or lingual part 7 of the nipple 2 has a very slightly convex shape at the centre with two lateral concavities 12, represented in FIG. 3, enabling correct positioning of the tongue (which forms a roll during suckling). Advantageously, the palatine part 6 of the nipple 2 is thicker than the lingual part of the nipple 2, which is 0.1 to 2 mm, preferably 0.5 to 1 mm, thick. On the lingual part of the nipple, the thickness of the material is thus small (see FIG. 4) to obtain high flexibility and enable the peristaltic movement of the tongue which causes milk to flow from the nipple. The surface of this area is perfectly smooth to enable the tongue to slide easily. This particular shape of the nipple 2 further (1) prevents the piston movement of the tongue against the palate, causing the palate to deepen to the detriment of the nasal passage and (2) reduces a significant sucking action which limits the transverse jawbone growth (like current teats).

To prevent palatine deformation, the nipple 2 is wider than it is high except at the "palatine bubble".

In any case, the upper part or palatine part 6 and the lower part or lingual side 7 of the nipple 2 are different to each other.

Preferably, the nipple 2 is provided, at the end thereof or on the uppermost surface thereof, with at least three perforations, preferably with 3 to 7 perforations, or more preferably with 5 perforations 8, intended for a liquid to flow, wherein the diameter is less than the perforation of conventional feeding bottles, preferentially a diameter of 0.3 to 0.6 mm, preferably about 0.4 mm making it possible to limit an excessive liquid flow caused by gravity and obtain a natural liquid flow, like a watering can.

Figure 5:
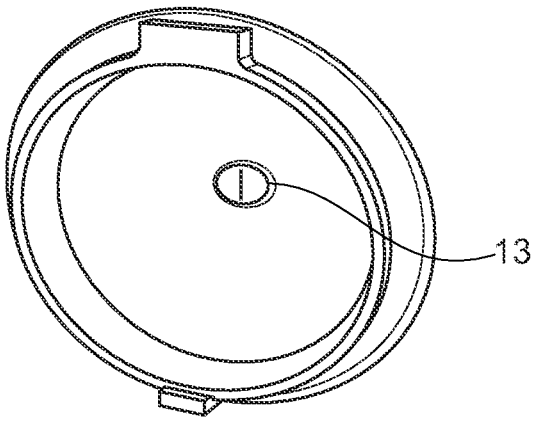
FIG. 5 represents a rear view of the inside of the teat according to the invention, showing a particular embodiment of the means for the controlled expulsion of milk, at the isthmus.

The isthmus 3 (represented as endobuccal in FIG. 7) is the part joining the nipple 2 and areola 4, said join being narrowed for the correct positioning of the lower and upper jawbones. The isthmus 3 further comprises means 13 (an embodiment whereof is represented in FIG. 5) for ensuring the controlled expulsion and flow of milk from the teat under the muscle action of the infant on the teat. Preferably, the means 13 for providing milk flow under the muscle action of the infant on the teat are: a valve, a bevelled opening, a flap which opens to allow the liquid, for example milk or water, to flow through when the isthmus is compressed, a diaphragm, a biconcave lens or any other suitable means. This means 13 may be moulded at the same time as the teat, or separately. According to a preferred embodiment of the invention, this means 13 is a valve incorporated in this area of the isthmus. This valve makes it possible to regulate the flow of milk in the nipple, but, according to a preferred embodiment of the invention, is never completely closed and the valve opening is only increased under the muscle action of the newborn (stimulation of lateral pterygoid, temporal and masseter muscles). Preferably, the valve consists of a 3 to 8 mm, preferably about 4 to 6 mm, more preferentially 5 mm, vertical slot, which, under the effect of pressure, forms a channel with a square cross-section (see FIG. 5). Milk flow is promoted by minimum vertical pressure from the mandible on said means, thus by the minimum muscular propulsion action required for mandibular growth. The action of the masticatory muscles (masseter, pterygoid and temporal muscles) further pulls the larynx into the upper position and thus seals between the oral cavity and the upper airways, thus limiting false passage and otitis phenomena.

Figure 7:
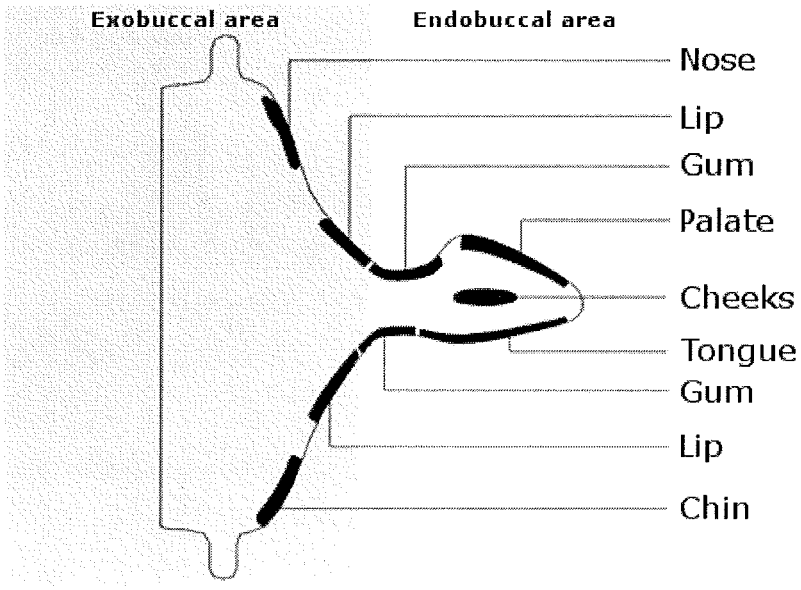
FIG. 7 represents a profile view of the teat, wherein the endobuccal part and the exobuccal part are shown. This figure highlights the areas in which the infant is in contact with the teat according to the invention.

The areola 4 (represented as exobuccal in FIG. 7) reproduces the shape of the breast when the infant's head presses against it. It has a very slightly concave shape, the infant's lips pressing on the half of the areola opposite the nipple. The areola has a sufficiently large diameter, or has a sufficiently wide neck, to ensure infant-teat contact from the chin to the nose. Advantageously, the neck of the areola is 40 to 50 mm in diameter. Advantageously, in the longitudinal cross-section thereof, the areola has a rounder, less triangular, shape (closer to the shape of the breast) than conventional teats, ensuring infant-teat contact from the chin to the nose. In the longitudinal cross-section thereof, the round shape of the areola ensures infant-teat contact from the chin to the nose. The areas in which the infant is in contact with the teat according to the invention are represented in FIG. 7.

The presence of the valve, the fineness of the material on the lingual side, the fineness of the milk flow perforations 8, and the shape of the areola contribute to the physiological action of the orofacial muscles and help correct the natural distoposition of the mandible in the newborn. Advantageously, the colour of the teat reproduces the colour of the maternal areola and nipple, i.e. a dark or light brown colour. Preferably, the surface condition of the teat is similar to that of the maternal breast.

As shown in FIG. 1, the teat according to the invention is modelled on the basis of 6 areas:

AREA 1: Area enabling the correct antero-posterior positioning of the infant's face with contact from the nose to the chin: concave shape; the function of area 1 of the teat is to provide 3 to 7 mm, preferably 4 to 6 mm, more preferentially about 5 mm, of antero-posterior elasticity, enabling front to rear movement of the teat in the infant's mouth. This function is enabled in that area 1 is in the form of a bellows with one or a plurality of folds (not shown) enabling deformation under the infant's actions, and return to the idle position.

AREA 2: Area enabling the positioning of the newborn's lips and correct latching thereof around the teat (action of the cheek and lip muscles): convex shape.

AREA 3: Area for positioning the upper and lower jawbones with upper and lower concavities for precise positioning of the teat in the infant's mouth. The inner part of area 3 contains the valve, the opening whereof is increased under pressure from the mandible, thus enabling action of the muscles associated with the temporomandibular joint (masseter, pterygoid and temporal muscles). This muscle action is essential for correcting natural neonatal retrognathism and enables complete closure of the bucco-laryngeal isthmus so as to prevent milk reflux in the infant's upper airways, and ensuing otitis.

AREA 4: Area 4 comprises an upper part and a lower part. The upper part is a convex area enabling the perfect alignment of the teat on the palate. The lower part is an area receiving the tip of the tongue just above and to the rear of the mandible. In the top view, area 4 is U-shaped, promoting normal dental arch development.

AREA 5: Area 5 comprises an upper part and a lower part. The upper part is a contact area with the palatal rugae, with a greater thickness and more irregular texture for maximum teat hold (thicker and more resistant corresponding palatal mucosa). The lower part of area 5 is a lingual action area with a shape suitable for the shape of the tongue, and minimal thickness with a very smooth surface condition to enable peristaltic tongue movements.

AREA 6: Area 6 is the end part of the teat, the end whereof is situated at the hard palate/soft palate junction; this area 6 comprises at least three perforations, preferably 3 to 7 perforations, more preferentially 5 perforations 8, for natural milk flow.

Figure 6:
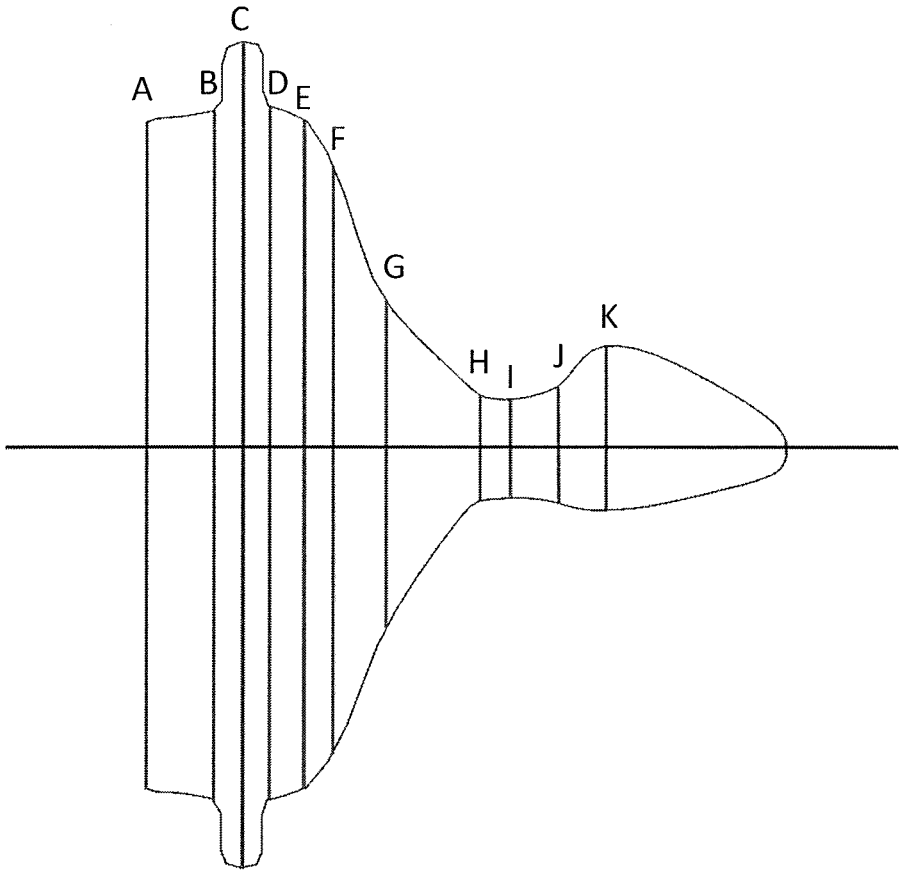
FIG. 6 represents a cross-section view of the teat according to the invention, marked with measurement reference marks.

FIG. 6 represents a cross-section view of the teat according to the invention, marked with measurement reference marks. In this way, at reference marks A, B, C, D in FIG. 6, corresponding to area 1 represented in FIG. 1, the teat according to the invention is between 45 and 55 mm high.

Preferably, at reference mark A, the teat is 40-50 mm high, preferably 42 to 45 mm high, more preferentially about 43.5 mm high.

Preferably, at reference mark B, the teat is 40-50 mm high, preferably 42 to 48 mm high, more preferentially about 45 mm high.

Preferably, at reference mark C, the teat is 45-55 mm high, preferably 50 to 54 mm high, more preferentially about 53.5 mm high.

Preferably, at reference mark D, the teat is 40-50 mm high, preferably 42 to 48 mm high, more preferentially about 45 mm high.

Preferably, at reference mark E, the teat is 40-50 mm high, preferably 42 to 45 mm high, more preferentially about 43.5 mm high.

Preferably, at reference mark F, the teat is 35-45 mm high, preferably 36 to 40 mm high, more preferentially about 38.5 mm high.

Preferably, at reference mark G, the teat is 15-55 mm high, preferably 18 to 23 mm high, more preferentially about 21.5 mm high.

At the isthmus 3, reference marks H to J, the teat is 5 to 10 mm high, preferably 6 to 9 mm high.

Preferably, at reference mark H, the teat is 5-10 mm high, preferably 6 to 8 mm high, more preferentially about 7 mm high.

Preferably, at reference mark I, the teat is 5-10 mm high, preferably 6 to 7 mm high, more preferentially about 6.5 mm high.

Preferably, at reference mark J, the teat is 5-10 mm high, preferably 6 to 9 mm high, more preferentially about 7.5 mm high.

At the palatine semi-bubble of the nipple 2 (reference mark K), the teat is 8-12 mm high, preferably 9 to 11 mm high, more preferentially about 10.5 mm.

According to a preferred embodiment of the invention, the feeding system according to the invention is designed such that the reservoir 9 rests on the upper part of the mother's bust in the central or side position to recreate the natural mother-infant "face to face" position. According to a preferred embodiment of the invention, the reservoir 9 has a conventional round cross-section. Advantageously, the reservoir 9 comprises means to be attached to a strap suitable for being placed around the mother's neck to form the artificial feeding system according to the invention. In this system, the reservoir 9 may advantageously rotate to the left or right, in order to facilitate the positioning of the infant.

Figure 8:
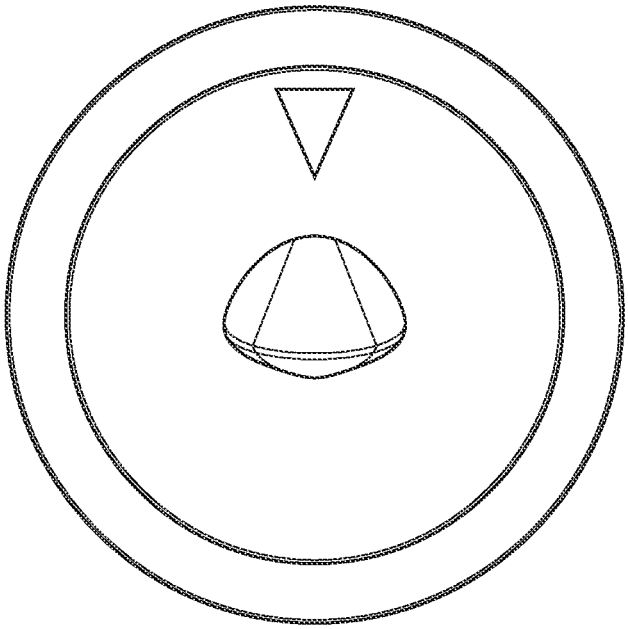
FIG. 8 represents a front view of the teat representing means, for example a marking line, for checking whether the asymmetric teat is positioned correctly in the infant's mouth.
Figure 9:
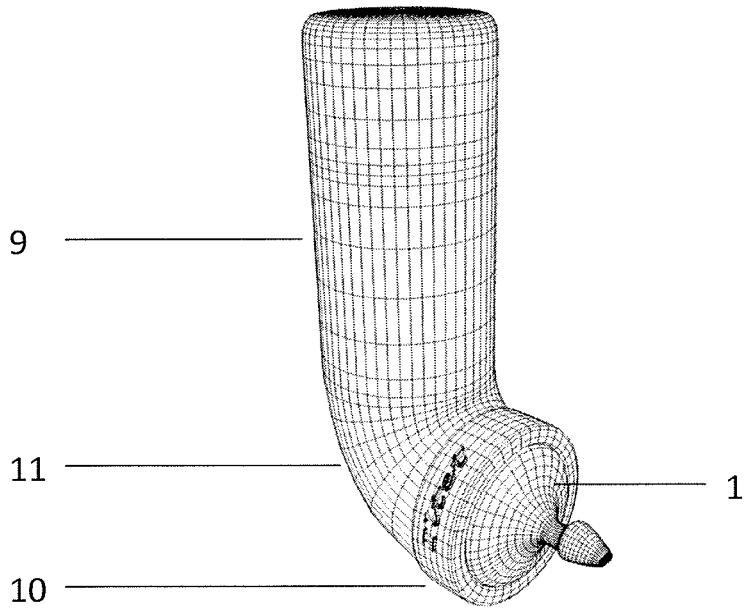
FIG. 9 represents a perspective view of the feeding bottle according to the invention.

Advantageously, the feeding bottle (one embodiment whereof is represented in FIG. 9) comprises a reservoir 9 suitable for having an angulation 11, a ring 10 and a teat 1, said ring 10 or said teat 1 comprising reference means, for example a line, for checking that the asymmetric teat 1 is positioned correctly in the infant's mouth: the reference means should be positioned opposite the infant's columella. According to a preferred embodiment, represented in FIG. 8, the mark is placed on the teat 1. According to a further embodiment, not shown, the mark is placed on the ring 10.

Unlike conventional feeding bottles, the mother's two hands can be involved in holding the infant, whose head is against or between the mother's breasts. The distance between the infant and the mother is thus reduced. The infant thus benefits from olfactory, visual, auditory, tactile and thermal stimulations.

Due to the angulation 11 of the reservoir, the infant is fed in a more upright position compared to conventional systems, which limits milk reflux in the upper airways and thus otitis. According to a preferred embodiment of the invention, the main part of the reservoir 9 has an angulation 11 of 60 to 110°, preferably 70 to 100°, more preferentially closer to 90° with the area for attaching the teat 1 enabling correct positioning of the infant for feeding wherein the reservoir has an angulation of about 90° such that a lengthwise axis of the teat and a lengthwise axis of a portion of the reservoir forms an angle of about 90°. The reservoir 9 has, at the end thereof opposite the teat 1, an opening receiving a silicone cap, preferentially in a Y-shape, which is to be removed during feeding so as to replace the liquid ingested, for example milk or water, by air, thus making it possible to improve the preservation of the qualities of the liquid, ensure the flow thereof and avoid excessive action by the infant's cheek muscles limiting transverse upper and lower jaw growth.

According to one preferred embodiment of the invention, the reservoir 9 is made of glass.

According to one particular embodiment of the invention, the feeding bottle further comprises a disk-shaped sieve placed at the bottle 9-teat 1 join before the skirt 5 of the teat 1. The function of this sieve is that of preventing the passage of lumps into the teat 1, particularly if, for example, milk formula is used.

The system according to the invention, which is more suitable for infant development than prior art systems, offers the further advantage of strengthening the mother-infant bond by stimulating the infant's various senses, by being as similar to breastfeeding as possible, providing a short, medium and long-term medical benefit on the infant's growth.

According to the present invention, the following terms refer to:

Temporomandibular joint: joint connecting the lower jawbones to the skull

Distoposition: position to the rear

Integrally formed refers to a part in one piece, or to a part that might be continuous in shape and wherein any components making up the part have been rendered inseparable.

Occlusion: relationship between the upper and lower dental arches

Malocclusion: pathological relationship between the upper and lower teeth

Mandible: lower jawbone

Maxilla: Bone supporting the teeth. The maxilla supports the upper dental arch and the mandible the lower dental arch Palate: Inner part of the maxilla Rugae: ridges in the gum situated at the palate, behind the incisors, which reduce in volume with age Peristalsis: wave motion

The invention claimed is:

1. A teat intended to be placed in an infant's mouth comprising:

a nipple, an areola, and an isthmus joining the nipple to the areola, the nipple comprising, at an end thereof, at least one perforation;

wherein:

the nipple comprises a palatine part and a lingual part which are asymmetric, said lingual part of the nipple has a convex shape at the center and two lateral concavities configured to enable correct position of a tongue during use;

the isthmus connects the nipple and the areola with a connection that is adapted for positioning of lower and upper jawbones during use, the isthmus being configured to ensure controlled expulsion and flow of a fluid from the teat during use and comprising a valve, a bevelled opening, a flap, a diaphragm, or a biconcave lens, said controlled expulsion being promoted by minimum vertical pressure on the isthmus during use; and the areola has a large diameter to ensure infant-teat contact from the chin to the nose.

2. The teat of claim 1, wherein the nipple further comprises a skirt.

3. The teat of claim 1, wherein the isthmus further comprises a valve comprising a 3 to 8 mm slot.

4. The teat of claim 1, configured to correctly position the nipple against an infant's palate during use, wherein the surface on the palatine part comprises at least one rough element.

5. The teat of claim 4, wherein the surface on the lingual part comprises a smooth surface and wherein the surface of the palatine part and the surface on the lingual part promote correct suckling function during use.

6. The teat of claim 1, wherein the palatine part of the nipple has a thickness of 1 to 5 mm and the lingual part of the nipple has a thickness of 0.1 to 2 mm.

7. The teat of claim 1, wherein the nipple is provided, at the end thereof or on the uppermost surface thereof, with at least 3 perforations.

8. The teat of claim 1, wherein the teat has a length, from the end of the nipple to an opposite end of the teat, ranging from 2.5 to 5.5 centimeters.

9. The teat of claim 8, wherein the teat has a length, from the end of the nipple to the opposite end of the teat, ranging from 3 and 5 centimeters.

10. The teat of claim 9, wherein the teat has a length, from the end of the nipple to the opposite end of the teat, ranging from 4 to 4.5 centimeters.

11. The teat of claim 1, wherein the teat comprises thermoplastic elastomer, latex, or silicone.

12. A feeding bottle comprising:

a teat of claim 1;

a reservoir, wherein the reservoir has an angulation of about 90°, and wherein the reservoir has an opening at an end thereof opposite the teat; and a ring for holding the teat onto the reservoir.

13. The teat of claim 6, wherein the isthmus connects the nipple and the areola, the connection of the isthmus to the nipple and areola is narrowed for the correct positioning of the lower and upper jawbones during use.

14. The teat of claim 13, wherein the nipple comprises a skirt.

15. The teat of claim 13, wherein the isthmus comprises a valve comprising a 3 to 8 mm slot.

16. The feeding bottle of claim 12, wherein the reservoir has an angulation of about 90° such that a lengthwise axis of the teat and a lengthwise axis of a portion of the reservoir forms an angle of about 90°.

* * * * *

UNITED STATES PATENT AND TRADEMARK OFFICE

CERTIFICATE OF CORRECTION

PATENT NO. : 8,833,575 B2
APPLICATION NO. : 13/393887
DATED : September 16, 2014
INVENTOR(S) : Francois Fave-Lesage It is certified that error appears in the above-identified patent and that said Letters Patent is hereby corrected as shown below:

In the Claims

Claim 1, Column 10, on lines 1-2, delete "two lateral con-cavities" and insert -- a lateral concavity on each side of the convex shape, the lingual part -- therefor.

Signed and Sealed this
Seventeenth Day of March, 2015

Michelle K. Lee

Michelle K. Lee
*Director of the United States Patent and Trademark Office*